United States Patent [19]

Lehmacher

[11] 4,270,908

[45] Jun. 2, 1981

[54] APPARATUS FOR THE STACKING AND CONNECTION OF SYNTHETIC-RESIN FOIL OR SHEET BAGS

[76] Inventor: Hans Lehmacher, 5215 Niderkassel-Mondorf, Fed. Rep. of Germany

[21] Appl. No.: 36,085

[22] Filed: May 4, 1979

[30] Foreign Application Priority Data

May 5, 1978 [DE] Fed. Rep. of Germany ..... 2819563

[51] Int. Cl.[3] ..... B31B 1/98

[52] U.S. Cl. ..... 493/204; 493/223

[58] Field of Search ..... 93/93 HT, 93 DP, 93 R, 93/33 H, 8 R; 414/50; 156/583.1

[56] References Cited

U.S. PATENT DOCUMENTS

| | | | |
|---|---|---|---|
| 2,414,059 | 1/1947 | Powers | 93/93 DP |
| 2,424,093 | 7/1947 | Harred | 93/93 DP |
| 3,631,770 | 1/1972 | Kratzert et al. | 93/93 DP |
| 3,971,481 | 7/1976 | Longenecker et al. | 414/50 X |
| 4,083,747 | 4/1978 | Rochla | 93/33 H X |

FOREIGN PATENT DOCUMENTS

| | | |
|---|---|---|
| 2004334 | 1/1970 | Fed. Rep. of Germany . |
| 2302477 | 10/1975 | Fed. Rep. of Germany . |

*Primary Examiner*—James F. Coan

*Attorney, Agent, or Firm*—Karl F. Ross

[57] ABSTRACT

An apparatus for stacking and joining, in a stack, bags of synthetic-resin foil or sheet material comprises a press for connecting the bags together at least along one edge, a conveyor for carrying the stack of connected bags out of the press, a device for stacking the bags and for transporting the stacked and unconnected bags to the press. According to the invention, the press is stationary and the stacking device comprises a plurality of tines upon which the bags are successively deposited against an abutment, the tines being then moved downwardly to deposit the bags on a grate along which the bags are displaced by a gripper to the conveyor and into the press.

7 Claims, 4 Drawing Figures

APPARATUS FOR THE STACKING AND CONNECTION OF SYNTHETIC-RESIN FOIL OR SHEET BAGS

FIELD OF THE INVENTION

The present invention relates to a device for the stacking and connection of synthetic-resin sheet or foil bags, hereinafter referred to as plastic bags and, more particularly, to a device for producing stacks, pads or blocks of interconnected plastic bags which can then be separated, one at a time, from the block or stack in use.

BACKGROUND OF THE INVENTION

In the manufacture of synthetic-resin foils or sheet (plastic) bags, the synthetic-resin material is usually blown to produce a foil or sheet which is flattened and sealed along various edges to provide the individual bags which can be separated from the continuous extruded material and packaged or assembled for distribution or use.

One of the principal forms of distribution is an assembly of such bags in a stack in which the bags are interconnected along, say, one edge, i.e. in a pad or block from which individual bags can be removed for use. A stack of bags can also be subdivided to form two or more blocks or pads and the blocks or pads can be wrapped, attached to a support or otherwise processed following assembly of the bags.

In order to stack the individual bags and join the stacks of bags, apparatus has been proposed to be provided downstream of the automatic bag-making machinery so as to constitute part of the automatic or assembly line production of padded bags.

The padding or stacking machinery can comprise a stacking surface upon which the bags are accumulated and which can be formed with or can be associated with an abutment or stop for the leading edge of the bags emerging at high speed from the bag-making machine, a padding press for joining the bags of a stack together, means for carrying away the pad or stack of interconnected bags, and a discharge device for the stack of interconnected bags.

In such systems, the conveyor is usually a belt conveyor which is operated periodically in accordance with a particular cycle, usually in the cadence of the press operation so that a stack of nonconnected bags is introduced into the press, the press is closed to bind the bags of the stack into connected or padded relationship, and the press is then opened for the conveyor to carry away the resulting pad or block.

In the press the interconnection of the bags can be effected by edge-welding or heat-sealing or by any other sealing technique which may take place concurrently with further processing in or adjacent the press. Such further processing can include, in addition to the steps previously mentioned, the formation of holes in the pad or block to enable the latter to be hung up, a subdivision of the stack or block into two or more pads or blocks, etc. the processing can be carried out with tools movable independently of the press or associated therewith.

A block-forming or bag-stacking machine for these purposes is described, for example, in the German patent document (Auslegeschrift) DE-AS 23 02 477. In this system, the press is mounted upon a carriage which is movable along with the conveyor and counter thereto so that the press can be brought into the region in which the bags are initially stacked. In other words the bags are stacked within the open press. When a given number of bags have been accumulated, i.e. the stack has reached the desired height and number of bags, the press is closed and the press is displaced with the pad during the interconnection of the bags via the conveyor belt, past whatever stationary processing tools may be required to act upon the stack, toward the discharge side of the machine. The press is then opened and the pads or blocks discharged. The press is then returned to the stacking side of the machine.

In practice, this system has been found to be comparatively slow since the press has a large inertial mass which can only be moved slowly and which cannot be accelerated or decelerated rapidly in a convenient manner.

Furthermore, while the press is not at the stacking location, the stacking of the bags must be interrupted. This is done in conventional systems by programming the bag-producing machine to have a certain number of nonproductive cycles corresponding to the time required for return of the press to the stacking location. In my experience ten or more such nonproductive cycles of the bag-producing machine must be provided for each pad or block to be produced.

A further disadvantage of this earlier system is that the stop or abutment for the leading edge of the bags is provided in the press which makes it difficult to remove improperly oriented bags or to have access to the stack during the stacking process in a convenient manner.

Mention should be made of the fact that in the paper and printing industries it is known to assemble or collate paper sheets or signatures to so-called stacks upon stacking surfaces having a grill between the bars of which a member can engage to move the stack. Reference may be had in this connection to U.S. Pat. No. 3,298,683. In this system, a pair of grill-shaped supports are required to displace the stack.

Reference may also be had to the German patent document (Auslegeschrift) DE-AS 20 04 334 in which the stack-receiving system can be raised and lowered and in which an array of bars can be provided as the receiving surface, the latter being drawn away from the stack.

In both these prior art devices described there is a relative movement along the plane of the receiving surface between the bars thereof and the stack when the stack is removed from the surface or the surface withdrawn from beneath the stack.

While this relative movement has little effect upon signature stacks and stacks of paper, it constitutes a barrier to the use of these techniques in the handling of plastic bags whose adhesion to one another is generally less than that between the lowermost bag and the bars upon which the stack is formed.

As a result, the relative movement gathers the lowermost bags and thereby disrupts the stack.

In German patent document (Auslegeschrift) DE-AS 23 02 477, however, this problem does not arise although it is essential to move the press or its carriage with the disadvantages enumerated above.

In general, therefore, it may be said that stacking techniques which have found prominence in the paper, printing, collating and bookbinding fields, in the assembly of stacks of interconnected leaves, cannot be used effectively in the formation of stacks, pads or blocks of plastic bags and, concomitantly these techniques for high speed stacking in the paper art cannot be used to advance techniques current in the art of stacking of plastic bags without introducing new disadvantages in this latter field.

OBJECTS OF THE INVENTION

It is the principal object of the present invention to provide an improved apparatus for the formation of stacks of blocks of interconnected plastic bags, whereby the disadvantages of prior art devices are avoided and the economies of operation of a plant incorporating the apparatus can be improved.

A more specific object of the invention is to provide a stacking machine, particularly effective in the stacking of plastic bags, which can be located downstream of a bag-making machine and which can form the bags into blocks or pads and carry out any further processing which may be desired of this blocks or pads without interrupting the feed of bags from the bag-making machine, i.e. without operating the latter with nonproductive cycles.

Still another object of the invention is to provide an improved apparatus for the high speed assembly of plastic bags into blocks, pads or stacks of interconnected bags at low cost.

It is also an object of the invention to provide a machine for the purpose described which is reliable, free from any tendency to damage or disrupt the stack, and which has moving parts capable of operating at high speed with a minimum of problems.

SUMMARY OF THE INVENTION

These objects and others which become apparent hereinafter are attained, in accordance with the present invention, in a machine or apparatus having the basic units described, i.e. a stacking device, a transfer device for shifting a stack from the stacking device, a press receiving the stack from the transfer device and capable of connecting the bags of the stack together, and a conveyor for carrying the block or pad of interconnected bags away from the press. The invention improves upon such an apparatus by, in combination with these elements, providing that the press is stationary, the stacking device is constituted as a receiving rack or grill with parallel spaced-apart tines extending in the direction of advance of the stack and associated with a stop engageable with the leading edges of the bags arriving from the bag-making machine, the stop comprising bars received between the tines in a stacking position of the rake, the path between the stacking location and the press is provided with a grill of stationary bars extending in the aforementioned direction and between which the tines can pass, while the transfer device comprises members engageable with the stack for drawing the same along these bars or elements into the press from which the stack can be carried by the conveyor.

The stacking rack, according to the invention, is provided with a drive which positions the rack in a starting position above the transfer grill or bars at the stacking location, the tines, in this location, interdigitating with downwardly extending fixed abutment rods of the aforementioned stop. In this position, the bag can be fed at high speed from the bag-making machine onto the stacking surface formed by the tines.

As the stack is formed (or subsequent to such formation), the stacking rake is lowered below the upper surface of the array of transfer bars, is withdrawn from below the deposited stack, is raised to its starting level and is returned to the stacking location to receive further bags.

The stack upon the transfer bars is engaged, in accordance with the present invention, by a gripper which carries the stack into the press and from which the stack is carried to the discharge end of the machine by the conveyor.

The invention utilizes the fact that the stack can be formed readily and without difficulty, at the rate of production of the bags, upon the stacking rake and can be transferred without damage to the stack or the lowermost bag or bags thereof, to the underlying array of bars (transfer bars) with the rake being withdrawn therebelow without any interruption in the feed of the bags, even when relatively long bags are produced, because the stack remains free to receive bags even while it is being lowered onto the transfer bar and provided the rake is advanced back into its starting position substantially at a speed corresponding to the speed at which the bags are fed.

The drive for the stacking rake can be relatively simple if, in accordance with the principles of the present invention, the rake is mounted upon a carriage which can be raised and lowered by a spindle and the rake is shiftable longitudinally on the carriage by a fluid-press cylinder. The spindle can be driven by a reversible electric motor while the rake can be coupled to the aforementioned cylinder via a substantially horizontal lever fulcrumed at a fixed location and pivotally connected to the piston of this cylinder. The lever thus acts as a motion multiplying device which can control the speed of the stacking rake in accordance with the relative length of the arms of the lever and, for example, the distance between the point at which the piston is pivotally connected and the fulcrum. In this case, as the force-application arm is reduced in length or the load arm of the lever is increased in length, the speed of the rake is increased.

The transfer device includes, as previously noted, a gripper which likewise can be of simple construction. In this case, the gripper device can be provided with a guide below the transfer bars which can extend from the stacking station to or beyond the press in the direction of advance of the stacks, a traverse or carriage being shiftable along this guide and being provided, over the width of the stack with a number of spaced-apart gripper jaws or tongs engageable with the leading edge of the stack when the latter is deposited upon the transfer bars.

The traverse can be driven mechanically, hydraulically or pneumatically and when the drive is hydraulic or pneumatic, it can be effected with an appropriate piston and cylinder arrangement.

However, it has been found to be particularly advantageous to provide an endless chain drive for the traverse which, in turn, is driven by an electric motor. This system has been found to be particularly effective when the traverse is also to carry a tool or the like capable of acting upon the stack in the press. Such a tool can be, for example, a blade adapted to subdivide the pressed stack into two or more blocks. In this case, while the tool is operating upon a previously pressed stack, in its movement with the traverse, the gripper may entrain a stack of unconnected bags into the press.

Naturally the press table, ram or plate should be provided with passages enabling the gripper to carry the stack into the press and to permit the tools to traverse the latter at least in part.

The apparatus of the present invention thus allows a stack to be formed upon the stacking tines while a previously formed stack is within the press for bonding of the bags together and any treatment which may be effected within the press. Upon opening of the press, the formed block or pad can be removed at relatively high speed by the conveyor since, after the bags of the stack have been united, there is no longer any danger that the stack will be damaged by such high speed movement. During the displacement of the finished stack out of the press, the gripper can carry the new stack into the press, independently of the operation of the conveyor and without any danger that adhesion phenomenon will damage the stack in spite of the fact that the bags thereof are not bonded together. Meanwhile the stacking rake can be effective in receiving bags for the formation of still a third stack.

The timing of the drive element can be effected by any conventional modern programming circuitry or sequencing system, well within the scale of the art, or via limit switches and the like responsive to positions of the various elements described. Furthermore, the position of the stop and the gripper fingers or jaws can be adjustable to enable the machine to stack and pad bags of different lengths while the strokes of the various elements can be modified together with their respective drives, to allow bags of different configurations to be padded.

A principal advantage of the system of the present invention is that it permits the stacking of bags and the formation of pads or blocks thereof without hardly any interruption of the feed of such bags from a bag-making machine and thus allows operation of the bag-making machinery at optimum speeds. Furthermore, because relative movement of the bags and the transfer elements does not take place in such fashion that the bags on the bottom of the stack are distorted, the stacking rate can itself be relatively high and the overall output of the system significantly greater than that of earlier pad or stack forming machinery.

BRIEF DESCRIPTION OF THE DRAWING

The above and other objects, features and advantages of the present invention will become more readily apparent from the following description, reference being made to the accompanying drawings in which.

SPECIFIC DESCRIPTION

Figure 1:
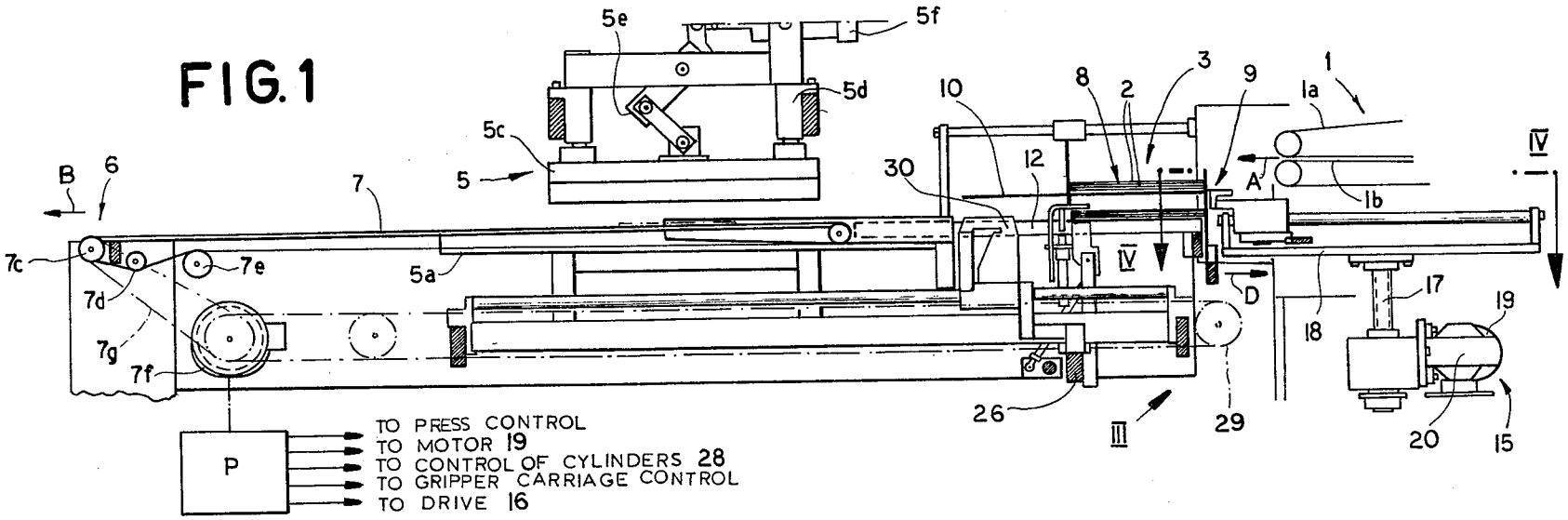
FIG. 1 is a diagrammatic side elevational view of a bag-stacking machine in accordance with the present invention.

The machine shown in the drawing is intended to operate in conjunction with a conventional bag-making machine represented at 1 and which has a pair of conveyor belts 1*a* and 1*b* between which a succession of plastic bags in closely following relationship, are fed at high speed in the direction of arrow A. The plastic bags have been represented diagrammatically at 2 and are composed, for example, of polyethylene film, foil or sheet by the blowing and heat sealing processes conventional in the art.

The bag stacking-machine of the present invention consists basically of a stacking station 3 provided with at least one abutment 4 engageable with the leading edges of the bags to orient them into a stack one above the other, a block-forming press 5, a block-discharge end 6 of the machine, and conveyors 7 for advancing the pad or block formed by bonding the bags of the stack together, to the end 6.

Figure 3:
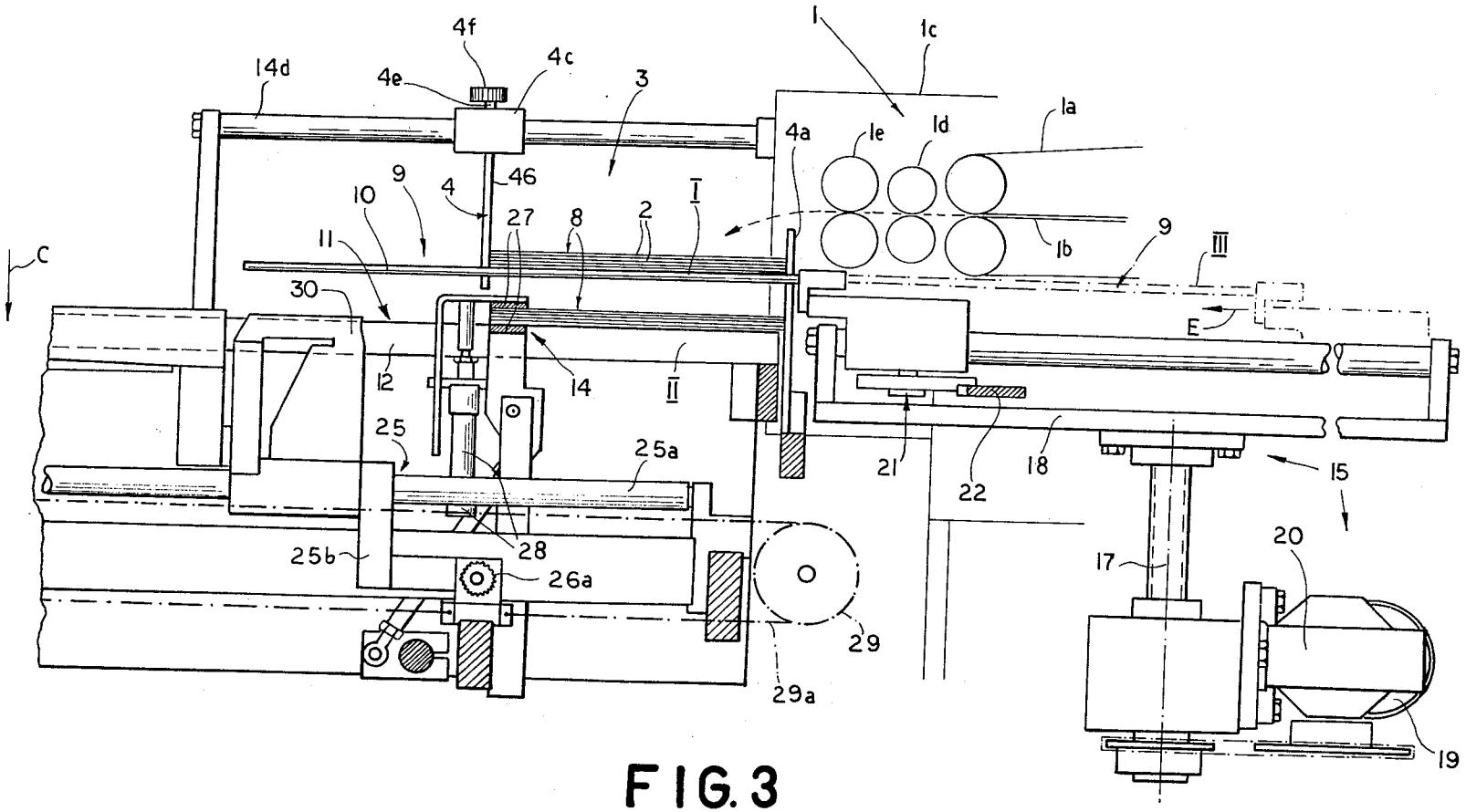
FIG. 3 is a detail cross-sectional view of the portion of the machine shown at III in FIG. 1.

A machine housing has been represented generally at 1*c* in FIG. 3 and between the conveyors 1*a* and 1*b* within the housing, there are diagrammatically, pairs of rollers 1*d* and 1*e* between which the bags are guided over an abutment 4*a* into engagement with the stop 4 to form a stack as represented at 8.

The stop 4 may comprise a plurality of downwardly extending rods 4*b* which are carried on a traverse 4*c* guided on a pair of bars 4*d*, only one of which can be seen in FIG. 3 and deposited on the opposite sides of the machine.

The traverse can be anchored in place along the guide bars 4*d* by a locking screw 4*e* having a milled head 4*f* so that the stop 4, adjustable for the length of the bags 2 emerging from the bag-making machine 1.

Figure 2:
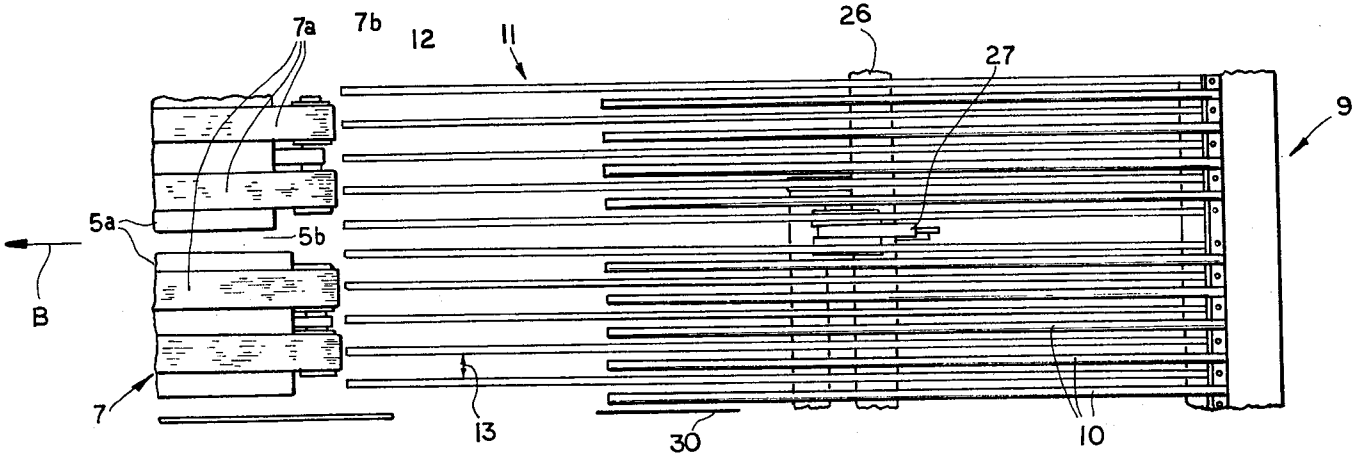
FIG. 2 is a plan view of a portion of the machine of FIG. 1.

The stationary press 5 has a bed plate 5*a* which can be provided with longitudinal openings 5*b* (see FIG. 2) within which the grippers can traverse the press as will be described subsequently. The upper platen 5*c* of the press, which can be heated for welding of the stack together along one edge or elsewhere as required to bond the bags together into a block or pad, can be displaced vertically on guides 5*d* by a toggle linkage 5*e* driven by a hydraulic or pneumatic fluid cylinder arrangement represented only in part at 5*f*.

The conveyor 7 is made up of a plurality of transversely spaced belts 7*a* which ride over the platen 5*a* and pass around idler pulleys 7*b* at the upstream end of the press, the belts running over pulley 7*c* (FIG. 1) at the discharged end 6 of the machine and then in a return stretch over idler wheels 7*d* and 7*e*. An electric motor 7*f* is connected by a belt or chain drive 7*g* to the pulleys 7*c* to drive the conveyor 7 at high speed in the direction of arrow B. Intermittent operation of the motor 7*f* is effected by a programmer P connected to the motor 7*f* and to the other controlled elements of the system for sequential operation in the manner described hereinafter.

The conveyor 7 thus runs from the press 5 to the discharge end 6 of the machine and does not reach into the stacking station 3, the blocking press in the conveyor being operated intermittently (usually periodically) for the processing of each stack and its removal from the press.

According to the invention, the block-forming press 5 is stationary, i.e. at a fixed location along the transport path of the stacks of bags while the stacking station is provided with a stacking rake 9 whose tines 10 extend in the direction of advance of the stacks (arrow B). Also, in accordance with the invention, the stacking station 3 is provided with a transfer grate 11 which is disposed substantially at the level of the platen 5*a* and of the conveyor 7, being formed by transversely spaced bars reaching to the upstream ends of the belts 7*a* horizontally and with a transverse spacing 13 enabling the tines 10 to clear the bars 12 when the rake 9 is lowered. Between the stationary press 5 and the stacking station 3, a transfer device with a gripper 14 is provided as an essential element of the present invention, this gripper engaging the edge of a stack of unconnected bags for drawing this stack into the press.

The stacking rake 9 is provided with a drive system generally designated at 15 to lower the rake 9 with a stack 8 thereon from a starting position represented at I (FIG. 3) in the direction of arrow C to a position II in which the rake lies below the bars 12. The stack 8, having been deposited on the bars 12, the rake 9 is withdrawn in the direction of arrow D (FIG. 1) and is then raised to its original level at position III (FIG. 3) before having advanced to its starting position I in the direction of the arrow E at the same speed as the speed with which a bag emerges from the bag-making machine.

While a stack is formed upon the tines 10 in the position I (FIG. 3) a previously formed stack on the transfer bars 12 can be engaged by the gripper 14 and drawn into the press 5.

Figure 4:
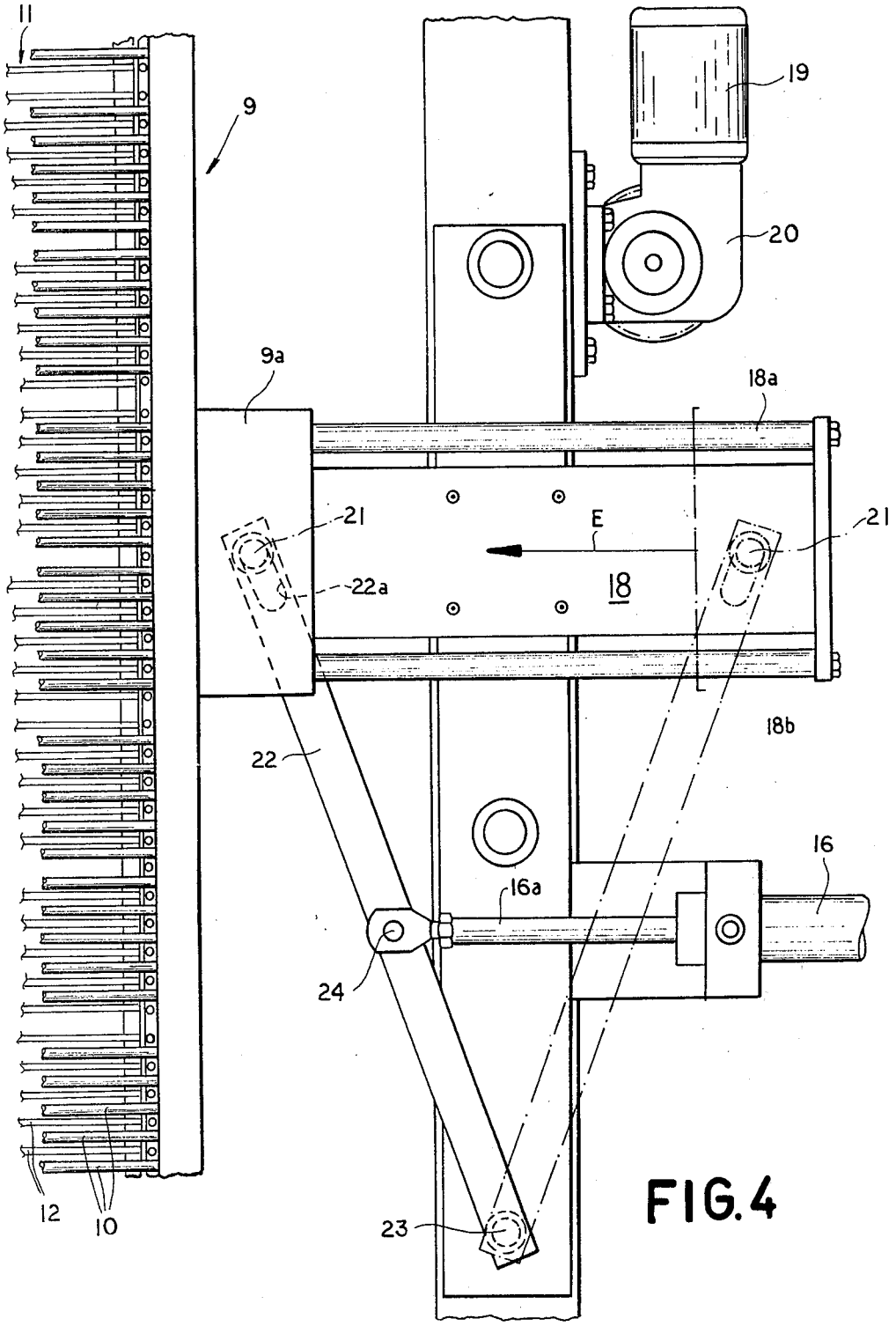
FIG. 4 is a cross-sectional view taken along the line IV—IV of FIG. 1 but drawn to a larger scale.

In accordance with a preferred embodiment, the stacking rake 9 is shifted from the final position III into its starting position I with a velocity equal to that at which the bags emerge from between the two rollers 1*e* over the stop 4*a*. The drive mechanism, for this purpose, is best seen in FIGS. 3 and 4.

More particularly, the threaded spindle 17, driven by the motor 19 and the speed reducing transmission, acts upon a carriage 18 so as to raise and lower the latter, i.e. to displace the stacking rake 9 between its upper and lower levels corresponding to the position shown at I and II, respectively. The carriage 18 is formed with a pair of rails 18*a* and 18*b* upon which a slide 9*a* of the rake 9 is guided for movement in the direction of arrow E.

Lever 22 is pivotally connected at 21 via a slot 22*a*, with the slide 9*a* and is fulcrumed at 23 at a fixed point on the carriage 18. The piston rod 16*a* of a fluid-pressure cylinder 16 is pivotally connected at 24 to the lever 22.

Upon actuation of the cylinder 16, through the usual control valves fro, say, the programmer P the rake 9 is shifted from the dot-dash line position shown in the direction of arrow E into a solid line position with speed multiplication depending upon the ratio between the distance between pivots 21 and 23 to the distance between pivots 23 and 24.

The transfer device comprises, as can best be seen from FIGS. 1 and 3, a track 25 formed by a pair of guide rails 25*a*, only one of which has been shown. The carriage 25*b* shiftable along this track includes a traverse 26 which can be alternately connected to the upper and lower passes of a drive chaine 29*a* passing over sprocket 29 or which is fixedly connected to the drive chain 29*a* when the latter can be driven in alternate directions from the motor 7*f* by a gripper carriage control not shown.

The traverse 26 carries a plurality of gripper tongs or pairs of jaws 27 which are spaced apart across the width of the stack and pass through the gaps between the bars 12 so that they can be engaged with the stack upon operation of fluid cylinders 28, e.g. via conventional valve control operated by the programmer P.

The traverse 26 and the carriage 25*b* also carry a blade 30 which subdivides the stack within the press into a pair of blocks or pads of the plastic bags ahead of the entrainment of a new stack into the press.

The positions of the gripper jaws 27 for bags 2 of various lengths can be adjusted by shifting the position of the traverse 26 along the carriage 25*b* via a set screw 26*a*.

In the operation of the apparatus of the present invention, actuation of the stop 4 during each formation of a stack is unnecessary since the rake 10 and the stack carried thereby drops below the stop 4 and the stop 4 can terminate above the path of the gripper jaws 27. Throughout the operation of the system, the stacks are freely accessible in the event a disorientation of the bags has occurred.

In the operation, the programmer P carries out the following sequence of steps assuming that initially the stacking rake 9 is in its solid line position I shown in FIG. 3, the gripper jaws 27 engaging an underlying stack 8 of bags, the press 5 is closed upon still another stack of bags and the conveyor 7 is immobile.

(a) While bags emerging from the machine 1 are stacked upon the rake 9, the transfer device 14 is shifted by chain 29*a* toward the press so that blade 30 severs the stack within the press as the new stack on the bars 12 is carried toward the latter.

(b) Press 5 is opened and conveyor 7 actuated at high speed to carry the pressed pads of bags to the discharge end 6. The gripper jaws 27 meanwhile positioning the new stack within the press.

(c) The rake 9 is lowered to deposit the forming stack upon the bars 12 (position II) and then shifted into position III and back into the path of the oncoming bags (position 1) as the gripper jaws 27 return to engage the new stack upon the bars 12.

(d) During the return of the gripper jaws 27, the press 5 closes to bond the bags therein into a pad or block, the conveyor having again been immobilized.

This sequence is repeated by programmed or limit switch control whenever an appropriate number of bags has accumulated on the rake 9.

I claim:

1. An apparatus for stacking and joining a succession of plastic bags which are separate from one another, said apparatus comprising:

a stacking device adapted to receive said separate bags in succession for stacking same and including:

a transfer grate having spaced-apart bars extending in a direction of displacement of stacks to be formed in said device, a stacking rake having tines receivable between said bars, a mechanism for shifting said rake from an upper position wherein said rake overlies said bars to receive and stack a succession of bags on the rake into a lower position below the upper surfaces of said bars whereby the stack on said rake is deposited on said bars, and at least one stop cooperating with said rake in said upper position thereof for aligning leading edges of bags deposited on said rake;

a press for bonding the bags of a stack into at least one block, said press being fixed at a location spaced from said stacking device in said direction;

a transfer device having gripper tongs disposed in at least some spaces between said bars and engageable with a stack deposited on said bars by said rake for entraining the latter stack into said press; and a conveyor adapted to receive a stack within said press for entraining the pressed stacks in the direction of a discharge end of the apparatus in said direction, said mechanism being constructed and arranged to draw said rake from below said surface in a direction opposite the first-mentioned direction and raise same to the level of its original position above said bars prior to feeding said rake into said original position, said mechanism feeding said rake into said original position at a speed substantially corresponding to the speed at which bags are fed to said rake.

2. The apparatus defined in claim 1 wherein said stop includes a plurality of rods extending downwardly and interdigitated with said tines in an upper position of said rake.

3. The apparatus defined in claim 1 wherein said transfer device comprises:

a guide track extending in said direction;

a carriage shiftable on said track; and a plurality of gripper tongs mounted on said carriage and spaced apart across the width of a stack received on said surface.

4. The apparatus defined in claim 1 wherein said mechanism includes:

a carriage forming a guide for movement of said rake in said direction;

a motor-driven spindle connected to said carriage for raising and lowering same;

a speed-multiplying lever pivotally connected to said rake and fulcrumed to said carriage; and drive means on said carriage articulated to said lever.

5. The apparatus defined in claim 3, further comprising drive means for reciprocating said carriage along said track.

6. The apparatus defined in claim 5, further comprising a tool mounted on said carriage and engageable with a stack received in said press.

7. The apparatus defined in claim 5 wherein said drive means includes an endless chain extending along said track.

* * * * *